US010792796B2

(12) United States Patent
Wilson

(10) Patent No.: US 10,792,796 B2
(45) Date of Patent: Oct. 6, 2020

(54) CARTRIDGE EXTRACTOR ADAPTOR

(71) Applicant: William Eugene Wilson, Ormond Beach, FL (US)

(72) Inventor: William Eugene Wilson, Ormond Beach, FL (US)

(73) Assignee: William Eugene Wilson, Ormond Beach, FL (US)

( * ) Notice: Subject to any disclaimer, the term of this patent is extended or adjusted under 35 U.S.C. 154(b) by 266 days.

(21) Appl. No.: 15/727,538

(22) Filed: Oct. 6, 2017

(65) Prior Publication Data

US 2018/0133876 A1 May 17, 2018

Related U.S. Application Data

(60) Provisional application No. 62/421,158, filed on Nov. 11, 2016.

(51) Int. Cl.

| | |
|---|---|
| ***B25B 13/06*** | (2006.01) |
| ***B25B 13/48*** | (2006.01) |
| ***B25B 27/24*** | (2006.01) |
| ***B25B 27/06*** | (2006.01) |

(52) U.S. Cl.
CPC ..... *B25B 27/24* (2013.01); *B25B 13/06* (2013.01); *B25B 13/48* (2013.01); *B25B 27/06* (2013.01)

(58) Field of Classification Search
USPC ..... 81/3.31, 176.2; 29/264, 257, 261, 280
See application file for complete search history.

(56) References Cited

U.S. PATENT DOCUMENTS

| | | | | |
|---|---|---|---|---|
| 4,836,065 | A * | 6/1989 | Setliff | B25B 27/0042 81/124.2 |
| 5,054,179 | A * | 10/1991 | Rini | B25B 13/48 29/213.1 |
| 5,519,929 | A | 5/1996 | Bleckman | |
| 5,794,644 | A | 8/1998 | Paylor | |
| D434,291 | S * | 11/2000 | Kim | D8/21 |
| 6,212,709 | B1 | 4/2001 | Newton | |
| 6,564,679 | B1 * | 5/2003 | Llamas | B25B 13/02 81/124.2 |
| 6,701,807 | B1 * | 3/2004 | Gammon | B25B 13/02 81/119 |

(Continued)

OTHER PUBLICATIONS

How to Remove & Replace a Moen Shower Valve Cartridge—Posi Temp Repair found at: https://www.youtube.com/watch?v=i0okT6ONNFU (Year: 2013).*

(Continued)

*Primary Examiner* — Lee D Wilson
*Assistant Examiner* — Mahdi H Nejad
(74) *Attorney, Agent, or Firm* — William Eugene Wilson

(57) ABSTRACT

A cartridge extractor adaptor having a cylindrical adaptor configured to engage between a cartridge puller and faucet housing in order to extend the pulling force of the cartridge puller. The cartridge extractor adaptor may be constructed of a composite or a metal alloy, having a tensile strength and wall thickness that is substantially greater than the pulling force generated by the cartridge puller. The cartridge extractor adaptor is structured and arranged having a hollow core body with a tool receiver flange at its proximal end, and a valve housing receiver flange at its distal end. The hollow body includes a pair of cartridge guide relief openings in the sidewall.

7 Claims, 5 Drawing Sheets

(56) References Cited

U.S. PATENT DOCUMENTS

| | | | | |
|---|---|---|---|---|
| 7,036,402 | B1 | 5/2006 | Marks | |
| D629,820 | S * | 12/2010 | Van Ryswyk | D15/139 |
| D633,782 | S * | 3/2011 | Tompkins | D8/382 |
| 7,987,571 | B2 | 8/2011 | English | |
| 2005/0098001 | A1 | 5/2005 | Walker | |
| 2010/0064859 | A1 * | 3/2010 | Stephens | B25B 13/065 81/125 |
| 2018/0257207 | A1 * | 9/2018 | Polofsky | B25B 13/481 |

OTHER PUBLICATIONS

How to use cartridge puller to remove Moen cartridge DIY video #diy #moen #cartridge #puller found at: https://www.youtube.com/watch?v=mGagKIXqTjA (Year: 2019).*

Cartridge Extractor Adaptor found at: https://www.youtube.com/watch?v=pZrbd4-I9IE&feature=youtu.be (Year: 2020).*

* cited by examiner

CARTRIDGE EXTRACTOR ADAPTOR

CROSS REFERENCE TO RELATED APPLICATION

The present application is related to and claims priority to U.S. Provisional Patent Application No. 62/421,158 filed Nov. 11, 2016, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of hand tools and more specifically relates to a cartridge extractor adaptor.

2. Description of the Related Art

When replacing a valve cartridge in a common household faucet, the old valve seated within the valve housing frequently becomes 'stuck' or seized within the valve housing requiring the use of a valve cartridge puller. In general, a valve cartridge puller is effective when used as prescribed by its manufacturer. However, due to the structural design of the tool, the length of its pulling force may be very limited and often does not fully disengage the internal seals of the valve cartridge from the valve housing causing the repairer to forcibly pry the cartridge from the valve housing using a screw driver or a pair of pliers. This can damage the valve housing, resulting in additional time consumption and costly repairs. This is not desirable.

U.S. Pat. No. 7,987,571 to Richard Le Roy English relates to a tool for pulling a mixing valve cartridge core and sleeve and method of use. The described tool for pulling mixing valve cartridge core and sleeve and method of use includes a system for removing single handle cartridges from housings of faucets and showers comprised of a core puller and a sleeve puller. The core and the sleeve of the cartridge are pulled in two separate steps. The core is pulled by attaching the core puller to the stem of the core with the open end of the core puller placed against the faucet/shower housing. The T-handle of the core puller is turned pulling the core out of the sleeve of the cartridge. The sleeve of the cartridge is then loosened using the sleeve puller which is expansively attached to the sleeve and twisted left and right sharply until the sleeve rotates inside the housing. The sleeve is then pulled by attaching the core puller to the outer end of the sleeve puller and turning the T-handle of the core puller to pull the sleeve puller and sleeve from the housing.

BRIEF SUMMARY OF THE INVENTION

In view of the foregoing disadvantages inherent in the known tool adaptor art, the present disclosure provides a novel cartridge extractor adaptor. The general purpose of the present disclosure, which will be described subsequently in greater detail, is to provide a tool for pulling a mixing valve cartridge core and sleeve, the present invention advantageously fills the aforementioned deficiencies by 'extending' the pulling force of the valve cartridge extractor. The present invention is superior to other systems in that it effectively provides an adaptor to extend the pulling force of the cartridge puller such that efficient removal is effectuated.

A cartridge extractor adaptor is disclosed herein. The cartridge extractor adaptor includes a cartridge extractor adaptor; the device comprising: a cylindrical adaptor configured to engage between a cartridge puller and a faucet housing; a cylindrical adaptor comprising a hollow core body configured to have a tool receiving flange at its proximal end. The device also comprises a valve housing receiving flange at its distal end, two cartridge guide relief openings in at least one sidewall extending from the distal end approximately 50% an overall length of the at least one sidewall and approximately 33% of a diameter width of the hollow core body. As structured and arranged the present invention is configured to effectively provide an adapting means to extend a pulling force of the cartridge puller in order to fully extract and remove a valve cartridge from the faucet housing.

A method of using the cartridge extractor adaptor is also disclosed herein. The method of using cartridge extractor adaptor may comprise the steps of: providing a cylindrical adaptor configured to engage between a cartridge puller and a faucet housing; and placing the valve housing receiver flange on the faucet housing, positioning the cartridge puller into the tool receiving flange, engaging the cartridge puller to cartridge, and extracting the cartridge. The method may further may comprise the steps of discarding the old the cartridge and storing the cartridge extractor adaptor and the cartridge puller for a future use.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a cartridge extractor adaptor, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a tool adapter and more particularly to a cartridge extractor adaptor as used to improve the efficiency of removal of cartridges.

Figure 1:
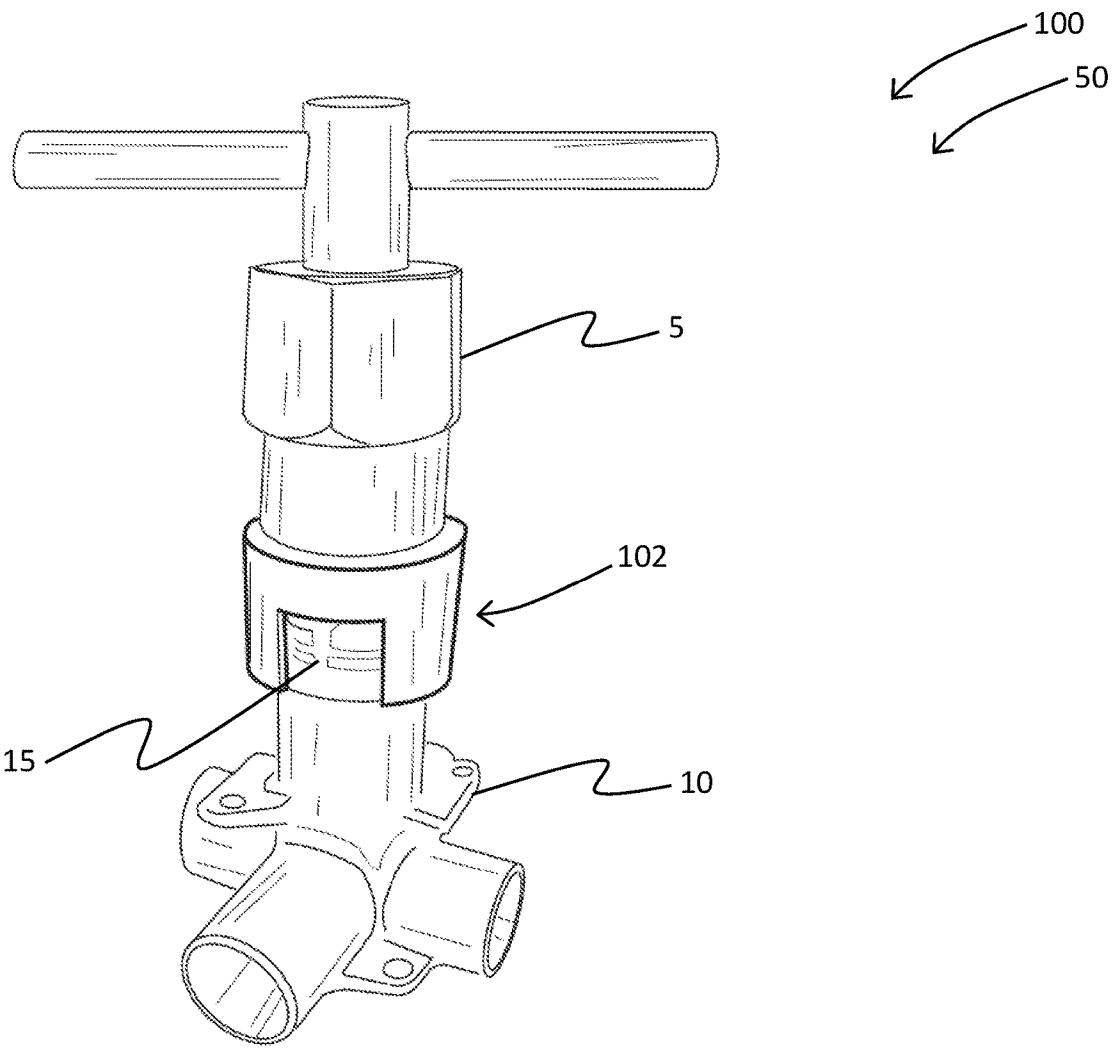
FIG. 1 is a front perspective view of the cartridge extractor adaptor during an 'in-use' condition, according to an embodiment of the disclosure.

Referring now more specifically to the drawings by numerals of reference, there is shown in FIGS. 1-5, various views of a cartridge extractor adaptor 100. FIG. 1 shows a cartridge extractor adaptor 100 during an 'in-use' condition 150, according to an embodiment of the present disclosure. As Illustrated, the cartridge extractor adaptor 100 may include a cylindrical adaptor configured to engage between a cartridge puller 5 and a faucet housing 10 the cylindrical adaptor may comprise a hollow core body 102 configured to have a tool receiving flange 104 at its proximal end 106 and a valve housing receiving flange 108 at its distal end 110. Hollow core body 102 may further include two cartridge guide relief openings 120 in at least one sidewall extending from the distal end 110 approximately 50% an overall length of the at least one sidewall and approximately 33% of a diameter width of the hollow core body 102. As such, the device is configured to effectively provide an adapting means to extend a pulling force of the cartridge puller 5 in order to fully extract and (fully) remove a valve cartridge 15 from the faucet housing 10.

Referring now to the drawings, there is shown in FIG. 1 the cartridge extractor adaptor 100 engaged between a cartridge puller 5 and a faucet housing 10 according to an embodiment of the present invention. As shown, the cartridge extractor adaptor 100 may statically be engaged between the faucet housing 10 and the cartridge puller 5 to extend the pulling range of the cartridge puller 5. A valve cartridge 15 may be extracted from the faucet housing 10 via the threaded engagement of the cartridge puller 5 by means of a rotational torque as applied by a user.

In continuing to refer to FIG. 1, the cartridge extractor adaptor 100 is shown comprising a sidewall having a pair of cartridge guide relief openings 120. The cartridge guide relief openings 120 are preferably situated on opposing sides of the sidewall and extending approximately 50% of the overall length of the sidewall.

Figure 2:
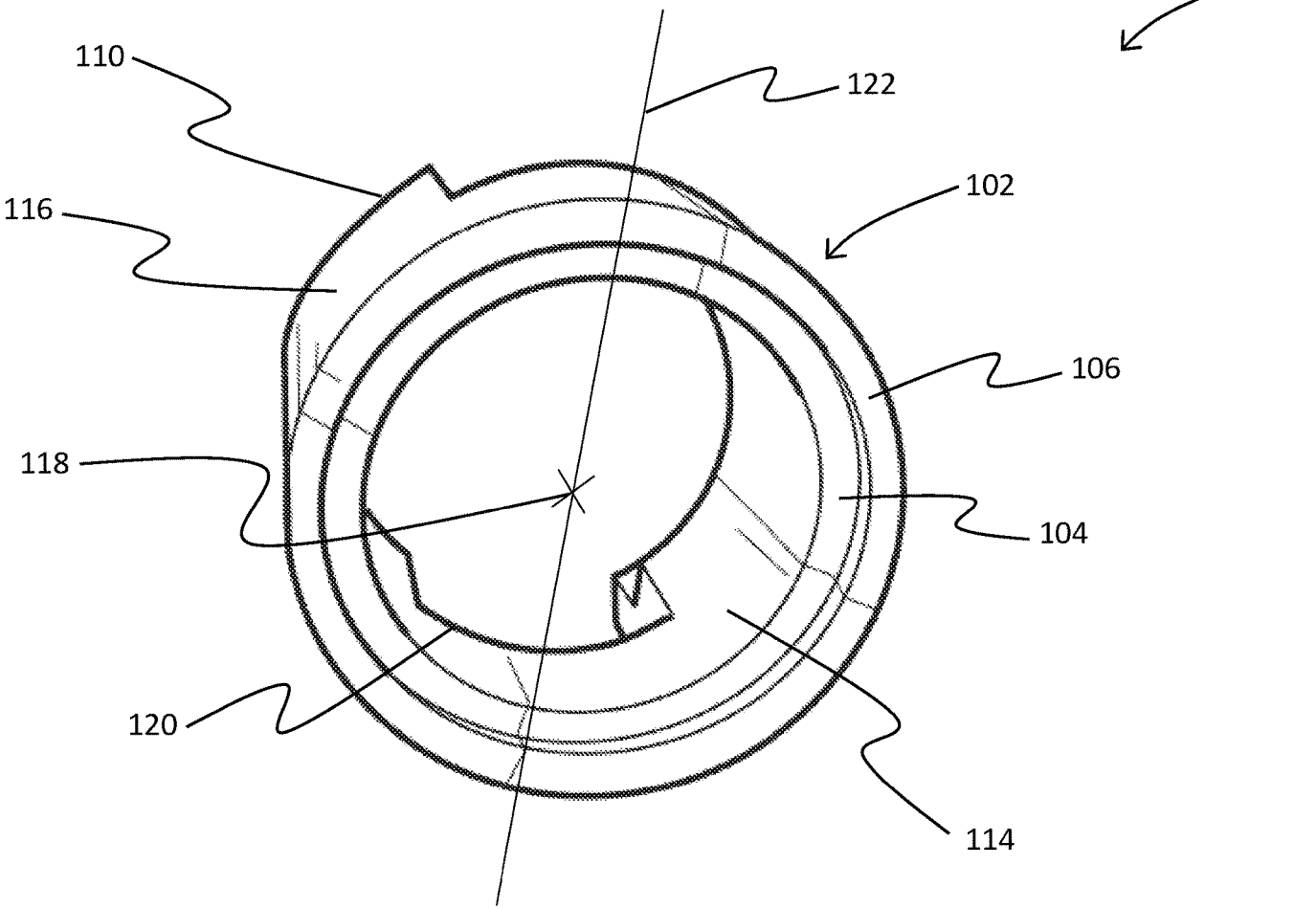
FIG. 2 is a proximal end view of the cartridge extractor adaptor of FIG. 1, according to an embodiment of the present disclosure.

FIG. 2 shows a proximal end view of the cartridge extractor adaptor 100 of FIG. 1, according to an embodiment of the present disclosure. As above, the cartridge extractor adaptor 100 may include the hollow core body 102 and may be defined by the cylindrical adaptor and may also be configured to engage between the cartridge puller 5 and the faucet housing 10. The present invention may additionally include tool receiving flange 104 at its proximal end 106. The tool receiving flange 104 may be useful for stabilizing the seated positioning of the cartridge puller 5 and providing linier alignment between the faucet housing 10 shown in FIG. 1 and the cartridge puller 5 also shown in FIG. 1 while extended pulling range is being provided by the cartridge extractor adaptor 100.

Further shown in greater detail in FIG. 2 the tool receiving flange 104 may be recessed into internal-sidewall 114 to a depth of 0.050 inch +/−−0.003, and the tool receiving flange 104 may be extended into the inner-sidewall 114 1.250 inch +/−0.003 from the internal center point 118 of 0. It should be noted that the hollow core body 102 may be preferably constructed of a metal alloy material, having a tensile strength and wall thickness 112 that may be substantially greater than the pulling force generated by the cartridge puller 5 such that the hollow core body 102 does not substantially deform during use. In other embodiments, the hollow core body 102 may be constructed of a durable composite material;

other materials may be used.

Figure 3:
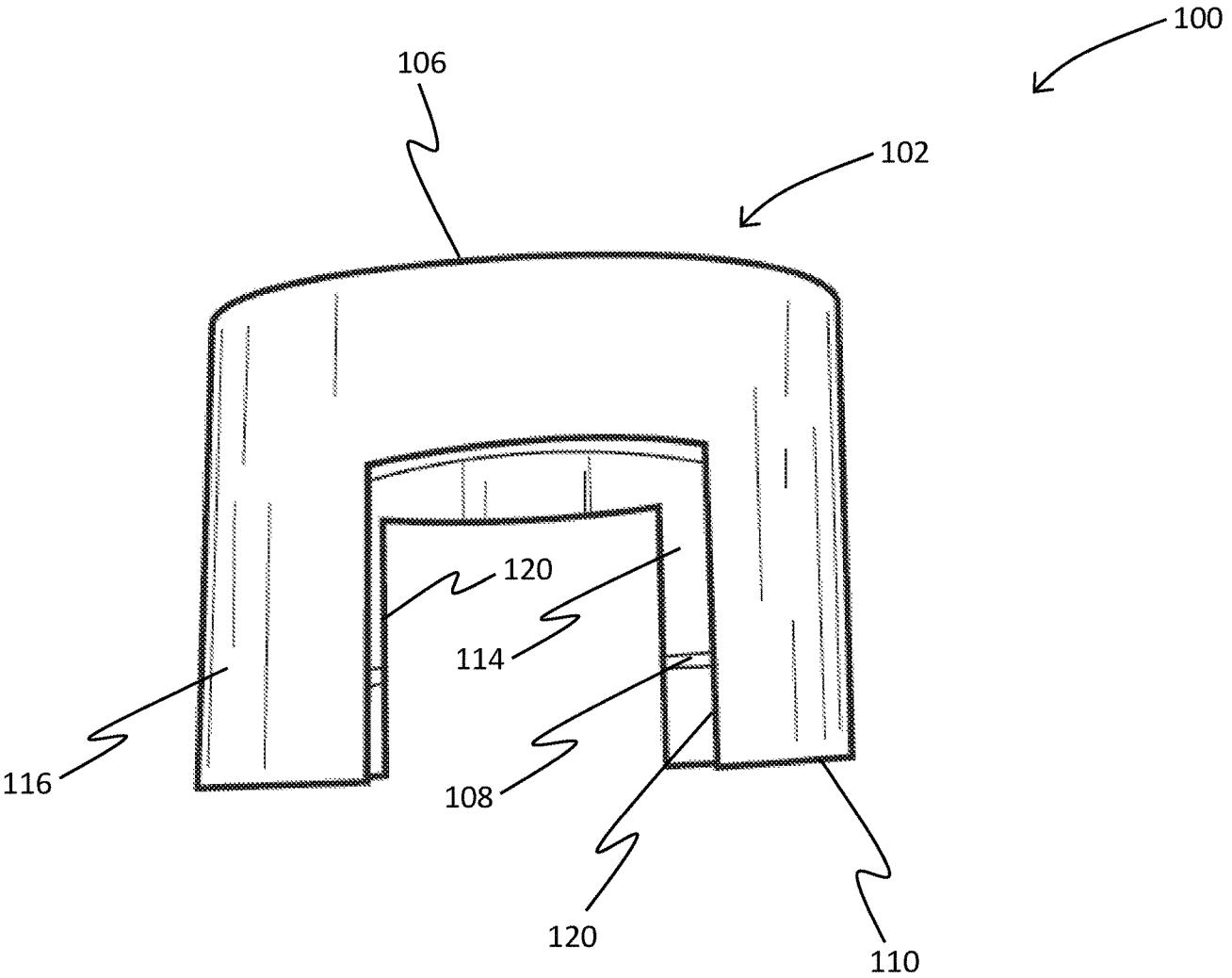
FIG. 3 is a side perspective view of the cartridge extractor adaptor of FIG. 1, according to an embodiment of the present disclosure.

FIG. 3 shows a side perspective view of the cartridge extractor adaptor 100 of FIG. 1, according to an embodiment of the present disclosure. As above, the cartridge extractor adaptor 100 may comprise a hollow body 102 having an internal side-wall 114 and an exterior side-wall 116 having pair of cartridge guide relief openings 120 extending from the distal end 110 approximately 50% an overall length. Further, the hollow body 102 may comprise pair of inner-sidewalls 116 having a valve housing receiver flange 108. The inner-sidewalls 116 may be separated by each of the cartridge guide relief openings 116 as detailed in FIG. 4. The valve housing receiver flanges 108 may be useful for stabilizing the positioning of the cartridge extractor adaptor 100 to the faucet housing 10 and preventing rotational torque.

Figure 4:
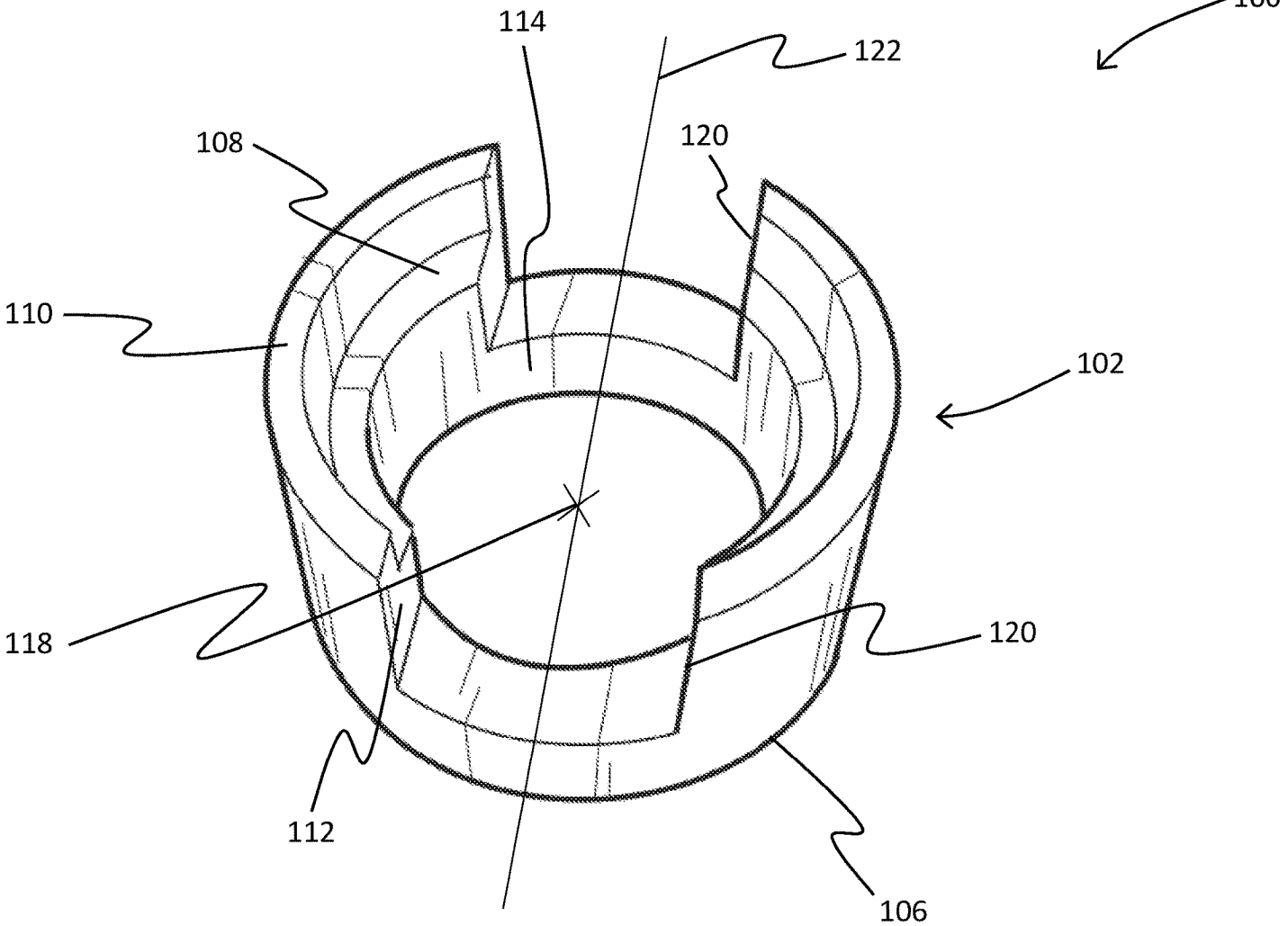
FIG. 4 is a distal end view of the cartridge extractor adaptor of FIG. 1, according to an embodiment of the present disclosure.

FIG. 4 shows a distal end view of the cartridge extractor adaptor 100 of FIG. 1, according to an embodiment of the present disclosure. As above, the cartridge extractor adaptor 100 may include a hollow core body 102 having an internal side-wall 114 and an exterior side-wall 116 at the distal end 110 and a valve housing receiving flange 108. Shown in detail as referred to in FIG. 3 the valve housing receiving flange 108 may be recessed into the internal-sidewall 114 at the distal end 110 to a depth of 0.250 inch +/−0.003, and the valve housing receiving flange 108 may be extended into the internal side-wall 114 1.280 inch +/−0.003 from the internal center point 118 of 0, and the distal end 110 may include a pair of opposing cartridge guide relief openings 120 in the side-wall.

As above, the cartridge extractor adaptor 100 may include a hollow core body 102 and may be defined by the cylindrical adaptor and may also be configured to engage between the cartridge puller 5 and the faucet housing 10 and may additionally include tool receiving flange 104 at its proximal end 106.

According to one embodiment, the cartridge extractor adaptor 100 may be arranged as a kit. The kit may include set of instructions. The instructions may detail functional relationships in relation to the structure of the cartridge extractor adaptor 100 (such that the cartridge extractor adaptor 100 can be used, maintained, or the like, in a preferred manner).

Figure 5:
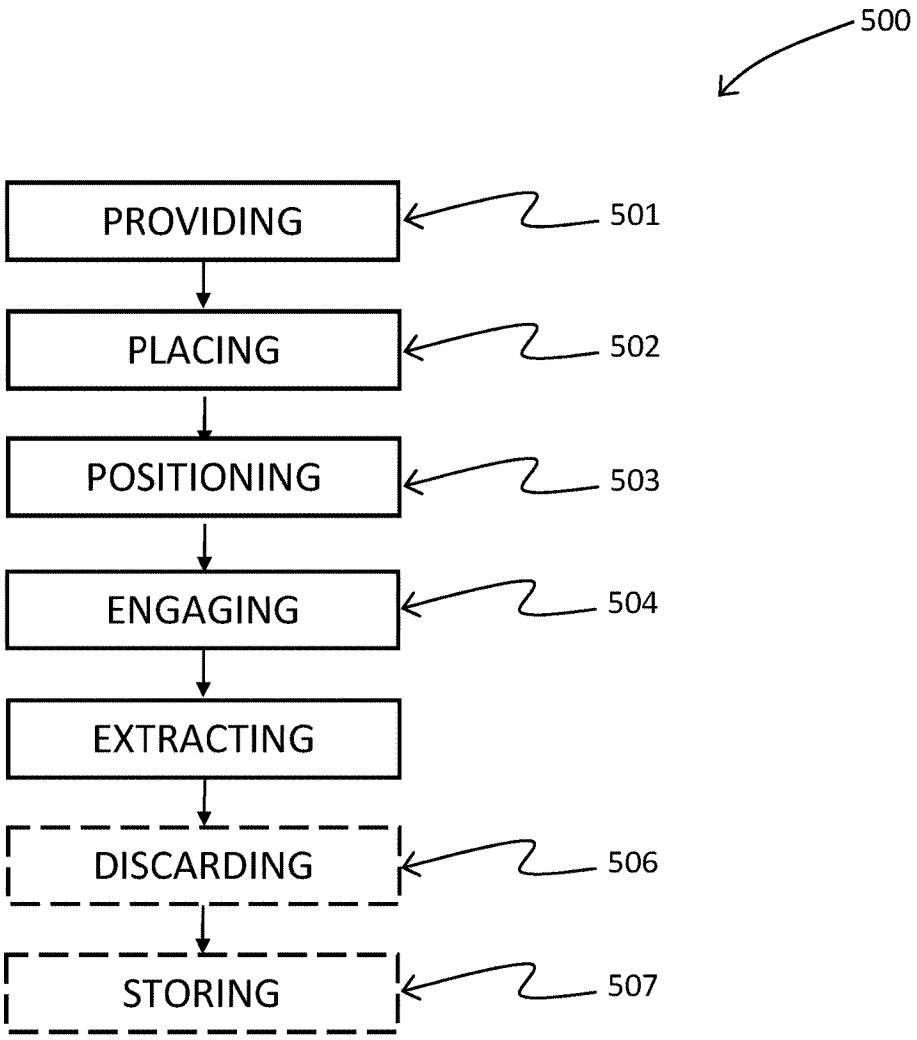
FIG. 5 is a flow diagram illustrating a method of use for the cartridge extractor adaptor, according to an embodiment of the present disclosure.

FIG. 5 is a flow diagram 550 illustrating a method of use 500 of cartridge extractor adaptor 100, according to an embodiment of the present disclosure. As illustrated, the method of use 500 of cartridge extractor adaptor 100 may include the steps of: step one 501, providing a cylindrical adaptor configured to engage between a cartridge puller 5 and a faucet housing 10; step two 502, placing the valve housing receiver flange 108 on the faucet housing 10; step three 503, positioning the cartridge puller 5 into the tool receiving flange 104; step four 504, engaging the cartridge puller 5 to the valve cartridge 15; step five 505, extracting the valve cartridge 15; step six 506, discarding the old valve cartridge 15 and step seven 507, storing the cartridge extractor adaptor 100 and the cartridge puller 5.

It should be noted that steps 506 and 507 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for cartridge extraction (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A valve cartridge extraction system comprising a cartridge extractor adaptor, a valve cartridge and a faucet housing;

the cartridge extractor adaptor comprising a cylindrical shaped adaptor and a cartridge puller;

the cartridge puller comprising a shaft and a nut shaped driving member;

the cylindrical shaped adaptor configured to engage with the valve cartridge to pull the valve cartridge out of the faucet housing;

the cylindrical shaped adaptor comprising a main hollow core interior, a tool receiving flange, a faucet housing receiving flange and two opposing valve cartridge openings;

the tool receiving flange is at proximal end of the cylindrical shaped adapter and configured to insertably receive a section of the cartridge puller, the tool receiving flange being recessed from the proximal end;

the faucet housing receiving flange is at distal end of the cylindrical shaped adapter and configured to insertably receive a section of the faucet housing for stabilizing the cartridge extractor adaptor on the faucet housing, the two opposing valve cartridge openings are configured to insertably receive two opposing stops of the valve cartridge; the two opposing valve cartridge openings are at the distal end of the cylindrical shaped adaptor and extending towards the proximal end of the cylindrical shaped adaptor and cut through the faucet housing receiving flange; the tool receiving flange and the faucet housing receiving flange are concentric; the tool receiving flange and the faucet housing receiving flange are larger in diameter than the main hollow core interior; the main hollow core interior located between the tool receiving flange and the faucet housing receiving flange in a longitudinal direction of the cylindrical shaped adaptor;

the cartridge puller is configured to extract the valve cartridge from the faucet housing by a rotational torque applied to the nut shaped driving member of the cartridge puller by a user.

2. The valve cartridge extraction system of claim 1, wherein the cylindrical shaped adaptor is made from a metal alloy material.

3. The valve cartridge extraction system of claim 1, wherein the cylindrical shaped adaptor is made from a composite material.

4. The valve cartridge extraction system of claim 1, wherein the cartridge puller further comprises a handle.

5. The valve cartridge extraction system of claim 4, wherein the handle is connected to an end of the shaft.

6. The valve cartridge extraction system of claim 4, wherein a longitudinal axis of the handle is perpendicular to a longitudinal axis of the shaft, and the handle passes through the end of the shaft.

7. The valve cartridge extraction system of claim 1, wherein the cartridge extractor adaptor is a kit and further comprises instructions of how to use and maintain the cartridge extractor adaptor.

* * * * *